United States Patent [19]

Roetynck et al.

[11] Patent Number: 4,917,870

[45] Date of Patent: Apr. 17, 1990

[54] INSTALLATION FOR PREPARATION OF STARCH GLUES

[75] Inventors: Michael Roetynck, Estaires; Michel Clabaux, Lestrem, both of France

[73] Assignee: Roquette Freres, France

[21] Appl. No.: 188,622

[22] Filed: Apr. 29, 1988

Related U.S. Application Data

[63] Continuation of Ser. No. 925,514, Oct. 27, 1986, abandoned, which is a continuation of Ser. No. 769,072, Aug. 26, 1985, abandoned.

[30] Foreign Application Priority Data

Aug. 24, 1984 [FR] France ..... 84 12306

[51] Int. Cl.[4] ..... B01F 3/12

[52] U.S. Cl. ..... 422/226; 366/150; 366/176; 422/135; 422/225; 422/232

[58] Field of Search ..... 422/135, 221, 224, 225, 422/226, 232, 240; 366/10, 11, 26, 64, 154, 155, 156, 163, 176, 177, 150; 285/223, 224; 106/130

[56] References Cited

U.S. PATENT DOCUMENTS

| | | | |
|---|---|---|---|
| 3,830,473 | 8/1974 | Lieferman et al. . | |
| 3,847,184 | 11/1974 | God | 285/223 X |
| 3,945,616 | 3/1976 | Lodige et al. . | |
| 3,948,491 | 4/1976 | Karlsson . | |
| 4,201,485 | 5/1980 | Walker-Wirz | 366/156 |
| 4,317,586 | 3/1982 | Campbell | 285/223 X |
| 4,323,314 | 4/1982 | Kaiser et al. | 366/177 X |
| 4,444,508 | 4/1984 | Kreuer et al. | 366/163 X |

FOREIGN PATENT DOCUMENTS

| | | | |
|---|---|---|---|
| 0051883 | 5/1982 | European Pat. Off. . | |
| 0096935 | 12/1983 | European Pat. Off. . | |
| 331294 | 8/1958 | Fed. Rep. of Germany . | |
| 2283937 | 4/1976 | France . | |
| 2451229 | 11/1980 | France | 366/156 |

*Primary Examiner*—Barry S. Richman
*Assistant Examiner*—Jill Johnston
*Attorney, Agent, or Firm*—Larson and Taylor

[57] ABSTRACT

The installation which is used for the preparation of starch glues comprises a vessel (1) having a substantially vertical axis (XY); that vessel is equipped with stirring means (2) acting at its lower level; it comprises furthermore pipes (8, 9, 10 and 11) to supply the vessel with all the constituents of the glue to be manufactured, the starch being introduced pneumatically in the form of powder through a pipe (12). The pipe (12) passes through the wall of the vessel from the outside to the inside of a level close to the lower portion of the vessel and in the vicinity of the stirring means (2).

1 Claim, 1 Drawing Sheet

INSTALLATION FOR PREPARATION OF STARCH GLUES

Figure 1:
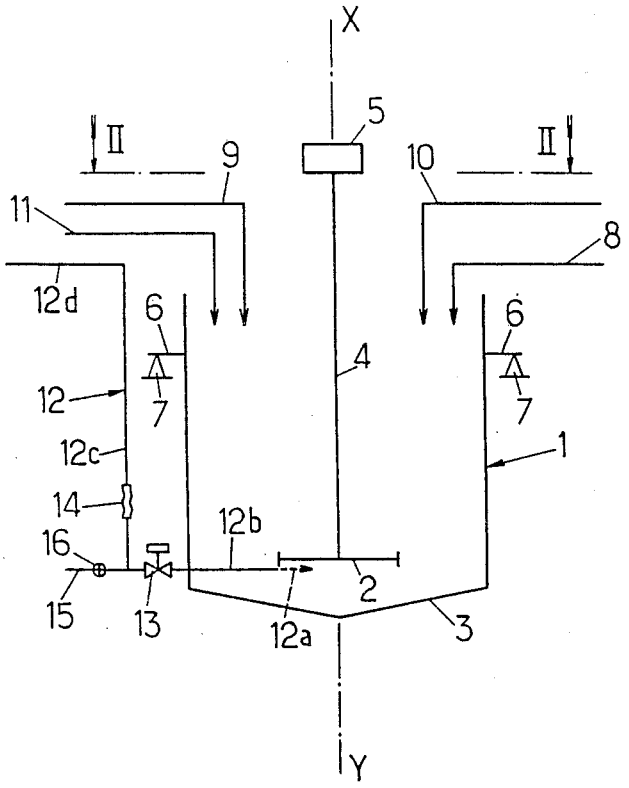

This application is a continuation of application Ser. No. 925,514 filed Oct. 27, 1986 which is a continuation of application Ser. No. 769,072 filed Aug. 26, 1985, both of which are now abandoned.

The invention relates to an installation for the preparation of starch glues intended for industry, particularly the paper making industry and more particularly for the manufacture of corrugated cardboard.

In installations of this type which already exist, for example, in the corrugated cardboard industry, the glue is prepared generally batchwise, in successive finished amounts, within a vessel with a vertical axis, equipped:

with stirring means arranged close to its bottom, as well as means adapted to introduce in predetermined amounts all the constituents necessary for the preparation of the glue and in particular the starch.

The starch is employed dry in the form of a commercial powder, delivered by pneumatic means at the level of the stirring means, that is to say in the midst of the glue in preparation.

By starch, is meant, throughout the description, native starches of any origin (wheat, corn, waxy corn, corn with a high content of amylose, potato, manioc and the like) as well as the corresponding modified starches which can be obtained particularly by physical or chemical modification of native starch.

The starch is introduced through piping which, from an upper level to the vessel, is bent downwards dipping thus into the vessel and extending inside the vessel, in a direction substantially parallel to the vertical axis of the vessel to the level of the stirring means.

The drawback of the installations concerned resides in the fact that at a height of the piping (parallel with the axis of the vessel) which corresponds to the final level of the glue contained in the vessel, there is produced after some manufacturing cycles, a deposit on the inner wall of the piping as a result of reascents of glue, that deposit causes is an internal narrowing of the pipeing; and the narrowing of the cross section of the piping causes a loss of pressure in the supply circuit of the powered starch and consequently an increasing lengthening of the time of introduction of the starch.

This deposit must be removed as soon as it becomes fairly substantial and the sound operation of the installation involves consequently, frequent cleaning which can be carried out by mechanical raking out and/or washing with water under pressure.

It is a particular object of the invention to overcome this drawback and to provide an installation of the type concerned which responds better than those preexisting to the various desiderata of practice and in which, particularly, the necessity of cleaning the piping for introducing the powdered starch becomes eliminated or at least infrequent.

Now, Applicants have the merit of having been able to find that this object could be achieved provided that the supply piping through which the starch is introduced into the vessel by pneumatic means, passes through the wall of the vessel from the outside to the inside of the vessel at a level close to the lower part of the vessel, in the vicinity of the stirring means placed within the vessel.

It follows that the installation according to the invention for the preparation, preferably discontinuously, of starch glues particularly for the manufacture of corrugated cardboard and which comprises essentially a vessel of substantially vertical axis equipped with stirring means acting at a lower level of the vessel as well as supply means of the said vessel with all the constituents of the glue to be manufactured and particularly with starch employed in the dry state in the form of powder led in through pneumatic means, is characterised by the fact that the supply means of the vessel with powdered starch comprise piping through which the starch arrives and which passes through the wall of the vessel from the outside to the inside of the vessel at a level close to the lower part of the vessel and in the vicinity of stirring means comprised by the vessel.

According to an advantageous embodiment of the above-said installation, the piping for supplying powdered starch comprises a part substantially parallel with the axis of the vessel and situated outside the vessel, this part extending from a level situated above the highest level that the glue can reach in the vessel to a substantially horizontal terminal part, passing through the wall of the vessel from the outside to the inside and opening at a level in the vicinity of the stirring means, preferably tangential to a circle described by the ends of the stirring means , said piping comprising, according to an advantageous embodiment of the invention, as close as possible to the vessel but outside the vessel, opening and closing means for the passage of the starch.

Figure 2:
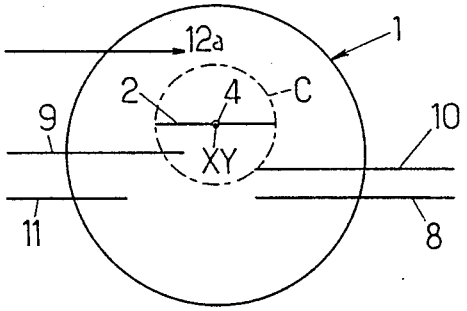

The invention is directed also at other features which are used preferably at the same time and it will, in any case, be well understandable with the aid of the additional description which follows and the examples, said additional description and examples, which are illustrated by the drawing in which:

FIG. 1 is a diagramatic cross section in elevation of an installation established according to the invention and FIG. 2, a diagrammatic plan view, with parts removed, along the line II—II, FIG. 1, being given in respect of advantageous embodiments of the invention.

Consequently, proposing to establish, according to the invention, an installation of the type concerned, procedure is as follows or in similar manner.

Said installation is made to comprise essentially a vessel of substantially vertical axis XY, and denoted overall by 1.

The vessel 1 comprises, as known, stirring means, for example a turbine 2, maintained in the vicinity of the bottom 3 of the vessel by a shaft 4, substantially parallel to the axis XY and which can be rotated by drive means 5.

Still as known, this vessel which rests through elements 6 on balance parts 7 of a balance member not shown, can be supplied:

with water, through a pipe 8, with NaOH, through a pipe 9, with borax, through a pipe 10 and with resin—for the manufacture of humidity resistant glues—, through a pipe 11, the pipes 8, 9, 10 and 11 being connected to tanks (not shown) for the products concerned.

The introduction of the starch is done through piping denoted overall at 12, arranged outside the vat and on which are mounted pneumatic means (not shown), for example, a device of the over-pressure type, under the influence of which the powdered starch is led to the vessel.

In accordance with the invention, the piping 12 passes through the wall of the vessel 1 and penetrates inside the vessel at a level situated in its lower part and in the vicinity of the level at which the turbine 2 is positioned, that is to say close to the bottom 3.

Advantageously, the end 12*a* of the piping 12 open tangentially at the circumference C described by the turbine, as shown in FIGS. 1 and 2.

The last part of the piping 12, through which the said piping penetrates into the inside, is advantageously constituted as shown by a horizontal element 12*b* and it follows a substantially vertical part 12*c* which itself is joined at a level above that which the glue can reach inside the vessel (to avoid any accidential reascent of the glue to the over pressure device), to a part 12*d* which connects the whole to the starch tank not shown and which comprises the over pressure means not shown.

In accordance with the invention, the pipe 12 comprises opening and closing means for the passage of the starch shown overall at 13 and which are positioned as close as possible and, preferably, outside the vessel 1; in the embodiment illustrated by the FIG. 1, they are positioned on the part 12*b*.

This opening and closing means 13 are advantageously constituted by a motorised isolating valve, for example of the spherical plug-valve type.

Taking into account the fact that the vessel which rests on the balance part 7 can effect vertical movements (by reason of the charge) and horizontal movements (by reason of the pneumatic transport) of limited amplitude, there is advantageously inserted in the part 12*c* of the piping 12 an elastic element 14 constituted, for example, by a piping element constructed of elastomer, permitting these movements.

For the eventuality of an accidential clogging of the part 12*b* of the piping 12 downstream of the isolating valve 13, there is provided at the level of the junction of the parts 12*b* and 12*c* and in the extension of the part 12*b*, an end-piece 15 comprising closure means 16 and permitting, in open position of said means 16 and of the valve 13, a raking out of the part 12*b* to proceed.

Installations of this type are intended to operate with charges comprising several hundreds of kg of starch and several thousands of liters of water.

The measurement of these amounts of starch and of water is done by means of the balance member to which the balance parts 7 are connected.

The precision reached is easily of the order of 1%.

The measurements of the amounts of NaOH, borax and possibly of resin introduced, amounts which are of the order of some kg or some tens of kg, is done preferably by means of volume measuring devices.

The operation of the installation, as regards the means for introducing into the vessel powdered starch, comprises the following sequence of operations:

putting into service of the over pressure device maintaining a constant flow-rate and establishing in the piping 12 a pressure comprised between 100 and 600 g/cm$^2$ and, preferably between 200 and 300 g/cm$^2$, limited by means of the calibrated valve type comprised by the over pressure device;

opening, generally after some seconds, preferably 2 to 3 seconds, of the motorised isolating valve 13, air entering the vat 1 and the pressure being established in the piping 12 at a value which is generally in practice of the order of 100 to 300 g/cm$^2$; the piping being under pressure, there is no reascent of liquid;

opening of the powdered starch distributor, opening into the piping 12, downstream of the over pressure device and the introduction of the starch into the vessel 1 under a pressure of the order of 500 to 600 g/cm$^2$ at the level of the turbine 2;

stopping of the distributor as soon as the desired amount of starch has been introduced;

introduction into the vessel 1, under air pressure, of the starch remaining in the piping 12; when all the starch has been driven into the vessel 1, the pressure in the piping 12 falls again to a value close to that that it had before the start of the placing in operation of the starch distributor;

closing of the isolating valve;

stopping of the over pressure device.

To fix ideas, it is pointed out that installations of the type concerned, constructed according to the invention, enable the preparation of the various usual types of glues for the paper industry (in particular glues of the Stein-Hall type, glues of the no-carrier type and humidity -resistant glues).

By way of example, there is indicated below the preparation of a glue of the Stein-Hall type.

In this case, the powdered starch input device is activated twice in the sequence indicated above.

In fact, the primary portion and the secondary portion of the glue of the Stein-Hall type are prepared successively in the vessel 1.

Procedure is as follows:

introduction into the vat 1 of 1000 liters of water through the pipe 8, introduction, with stirring effected by a turbine of the defluoculating type at a speed of 1500 rpm, of 100 kg of corn starch through the piping 12 along the sequence described above, heating of the water-starch mixture to a temperature comprised between 30° and 50° C. by live steam introduced in situ, introduction through the piping 12 of 30 liters of a NaOH solution comprising 400 g/l, maint enance of stirring for 10 to 15 minutes; rapid gelatinisation of the starch occurs manifested by an increase in the viscosity which reaches a value of 200 to 500 cps at the end of 10 to 15 minutes;

addition of 1500 liters of water, introduction through the piping 12, of 550 kg of starch along the sequence described above, stirring being kept constant, introduction through the pipe 10 of 8 kg of borax, stirring being maintained for 10 to 15 minutes, the glue then being ready for use and having a Stein-Hall viscosity of 50 to 70 seconds.

In this manner, by use of the installation according to the present invention, it has been possible to carry out more than 200 preparations of glues, in particular of the Stein-Hall type, without seeing the appearance of the usual clogging or choking encountered in installations according to the prior art which necessitate unclogging after about 30 to 50 preparations and sometimes as soon as from the 10th operation.

This being the case and whatever the embodiment adopted, there is thus provided an installation of the type concerned whose characteristics emerge sufficiently from the foregoing for it to be unnecessary to dwell further on the subject and which have, with respect to those preexisting, the aboveindicated advantages.

In addition, starch glues prepared according to the present invention may be used in all industries where starch based glues are customarily employed.

As is self-evident and as emerges besides already from the foregoing, the invention is in no way limited to those of its types of application and embodiments which have been more especially envisaged; it encompasses thereof, on the contrary, all modifications.

We claim:

1. An apparatus for the preparation of starch glues, particularly used in the manufacture of corrugated cardboard comprising an installation consisting essentially of a vessel having a lower part and a higher part and a substantially vertical axis equipped with stirring means acting at a level situated in the lower part of the vessel, as well as means for supplying the vessel with all constituents of the glue to be manufactured and essentially with starch employed in the dry state in the form of powder introduced by pneumatic means, the supply means of the vessel comprising piping through which the starch travels and which comprises a portion substantially parallel with the vertical axis of the vessel and situated outside the vessel, said portion which comprises an elastic element which permits vertical movements of limited amplitude of the vessel, extending from a level situated above the highest level that the glue can reach in the vessel to a lower, substantially horizontal terminal portion, which passes through the wall of the vessel from the outside to the inside and which opens at a level close to the stirring means, said horizontal terminal portion comprising, as close as possible to the vessel but outside with respect to the vessel, means for opening and closing the passage for the starch.

* * * * *